US007879777B2

(12) United States Patent
Tynik et al.

(10) Patent No.: US 7,879,777 B2
(45) Date of Patent: Feb. 1, 2011

(54) ANTIOXIDANT ADDITIVE FOR LUBRICANT COMPOSITIONS, COMPRISING ORGANOTUNGSTATE, DIARYLAMINE AND ORGANOMOLYBDENUM COMPOUNDS

(75) Inventors: Robert John Tynik, Norwalk, CT (US); Steven G. Donnelly, Bethel, CT (US); Gaston A. Aguilar, Milford, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 885 days.

(21) Appl. No.: 11/743,955

(22) Filed: May 3, 2007

(65) Prior Publication Data

US 2007/0203033 A1 Aug. 30, 2007

Related U.S. Application Data

(60) Provisional application No. 60/746,516, filed on May 5, 2006.

(51) Int. Cl.
*C10M 125/20* (2006.01)
*C10M 133/12* (2006.01)
*C10M 125/22* (2006.01)

(52) U.S. Cl. ..... 508/364; 508/545; 508/179

(58) Field of Classification Search ..... 508/170, 508/243, 179, 364, 545
See application file for complete search history.

(56) References Cited

U.S. PATENT DOCUMENTS 3,290,245 A * 12/1966 Scotchford et al. ..... 508/362
5,137,980 A * 8/1992 DeGonia et al. ..... 525/327.6
5,605,880 A 2/1997 Arai et al.
5,840,672 A 11/1998 Gatto
5,994,277 A 11/1999 Ritchie et al.
6,150,309 A 11/2000 Gao et al.
6,174,842 B1 1/2001 Gatto et al.
6,358,894 B1 3/2002 Leta et al.
6,726,855 B1 4/2004 Migdal et al.
6,806,241 B2 10/2004 Karol et al.
RE38,929 E 1/2006 Gatto et al.
7,335,625 B2 * 2/2008 Tynik ..... 508/362
2004/0214731 A1 * 10/2004 Tynik ..... 508/362
2005/0209111 A1 9/2005 Ruhe et al.
2006/0025313 A1 2/2006 Boffa
2007/0042917 A1 2/2007 Ravichandran et al.

OTHER PUBLICATIONS

See U.S. Appl. No. 11/743,409, filed May 2, 2007.

* cited by examiner

*Primary Examiner*—Glenn Caldarola
*Assistant Examiner*—Jim Goloboy
(74) *Attorney, Agent, or Firm*—Norris McLaughlin & Marcus, P.A.

(57) ABSTRACT

A lubricating oil composition contains a major portion of a lubricating base oil and an antioxidant additive at about 0.1-5.0 mass percent, the additive including:

a secondary diarylamine, an organo molybdenum compound, and an organoammonium tungstate compound.

7 Claims, 2 Drawing Sheets

ANTIOXIDANT ADDITIVE FOR LUBRICANT COMPOSITIONS, COMPRISING ORGANOTUNGSTATE, DIARYLAMINE AND ORGANOMOLYBDENUM COMPOUNDS

BACKGROUND OF INVENTION

Field of Invention

The present invention relates to lubricant compositions for imparting improved antioxidant properties. In particular, the invention relates to novel antioxidant compositions containing diarylamine antioxidant(s), organoammonium tungstate compound(s), and organo molybdenum compound(s) which provide significantly higher antioxidant activity than the single components or any two component combination when used in lubricants.

Engine oils function under severe oxidative conditions. The oxidative breakdown of the engine oil creates sludge and deposits, deteriorates the viscosity characteristics of the oil, and produces acidic bodies that corrode engine parts. To combat the effects of oxidation, engine oils are formulated with an array of antioxidants including hindered phenols, aromatic amines, zinc dithiophosphates (ZDDP), sulfurized hydrocarbons, metal and ashless dithiocarbamates, and organo-molybdenum compounds. Particularly effective antioxidants are alkylated diphenylamines (ADPAs), and ZDDPs. In combination, these two compounds provide the majority the of the antioxidant capacity in engine oils under current practice. However, the use of ZDDP in engine oils is declining due to the poisoning effect of phosphorus on exhaust after-treatment catalyst. In addition, sulfur and metal levels in engine oils are also in decline due to the effect of sulfated ash exhaust after-treatments. Thus, a need exists for effective antioxidant chemistry that can reduce or eliminate the need for phosphorus and sulfur containing antioxidants while maintaining lowest metal content possible.

It has been disclosed that organomolybdenum compounds are effective antiwear, friction reducers, and synergists to secondary diarylamine antioxidants and that organoammonium tungstates are effective antiwear additives. Furthermore, the present applicants have discovered, as set forth in co-pending U.S. Ser. No. 11/743,409 filed May 2, 2007, that organoammonium tungstate compounds are effective synergists to secondary diarylamine antioxidants.

In U.S. Patent Application 2004/0214731 A1, Tynik discloses that organoammonium tungstate compounds are effective antiwear additives that contribute no phosphorus or sulfur to lubricating composition.

In the above-mentioned co-pending application, inventors herein teach that unlike ZDDP, these organoammonium tungstate compounds alone do not effectively inhibit oxidation of lubricating compositions. However, in the presence of secondary diarylamines, organoammonium tungstate compounds act synergistically to provide oxidation control much improved over either of the components separately.

U.S. Pat. No. RE 38,929 discloses a lubricating oil composition which contains from about 100 to 450 parts per million of molybdenum from a molybdenum compound which is substantially free of active sulfur and about 750 to 5,000 parts per million of a secondary diarylamine. This patent alleges that this combination of ingredients provides improved oxidation control and friction modifier performance to the lubricating oil.

However, because of the high costs associated with metals such as molybdenum and tungsten and the impact this cost has on the treat levels and overall cost of the additive packages, there is interest to minimize their levels in lubricating composition while optimizing their antioxidant and antiwear effects. Besides cost, molybdenum presents problems or concerns with respect to copper/lead bearing corrosion, rust inhibition and particularly with the ball rust test that is part of the GF-4 specification for engine oils. Still further, it is the concern with respect to the TEOST 33 procedure being proposed for GF-5. That test looks at deposit control under high temperatures and exposure to NOx environments. It has been found that with Mo levels higher than 350 ppm, high levels of deposits are formed, which makes it difficult to formulate oil that will pass the proposed GF-5 specification. Until now, however, suitable formulations which can obtain the benefits of molybdenum, while limiting or avoiding the detrimental properties described herein, have not been found.

SUMMARY OF THE INVENTION

It has now been discovered that a combination of (A) secondary diarylamine antioxidant(s), (B) organo molybdenum compound(s), and (C) organoammonium tungstate compound(s) provides significantly improved antioxidation characteristics. These three components provide antioxidation properties improved over the combination of (A) secondary diarylamine antioxidant(s), and (B) organo molybdenum compound(s) or (A) secondary diarylamine antioxidant(s), and (C) organoammonium tungstate compound(s). This invention contributes no phosphorus or sulfur to engine oil while minimizing secondary diarylamine, molybdenum, and tungsten contents. Specifically, oil compositions will contain from 0.01 to 0.5 mass percent secondary diarylamine (preferably 0.1 to 0.5 mass %), 50 to 350 ppm molybdenum, and 100 to 3,000 ppm tungsten.

DETAILED DESCRIPTION

Component (A)

Secondary Diarylamine(s)

Figure 1:
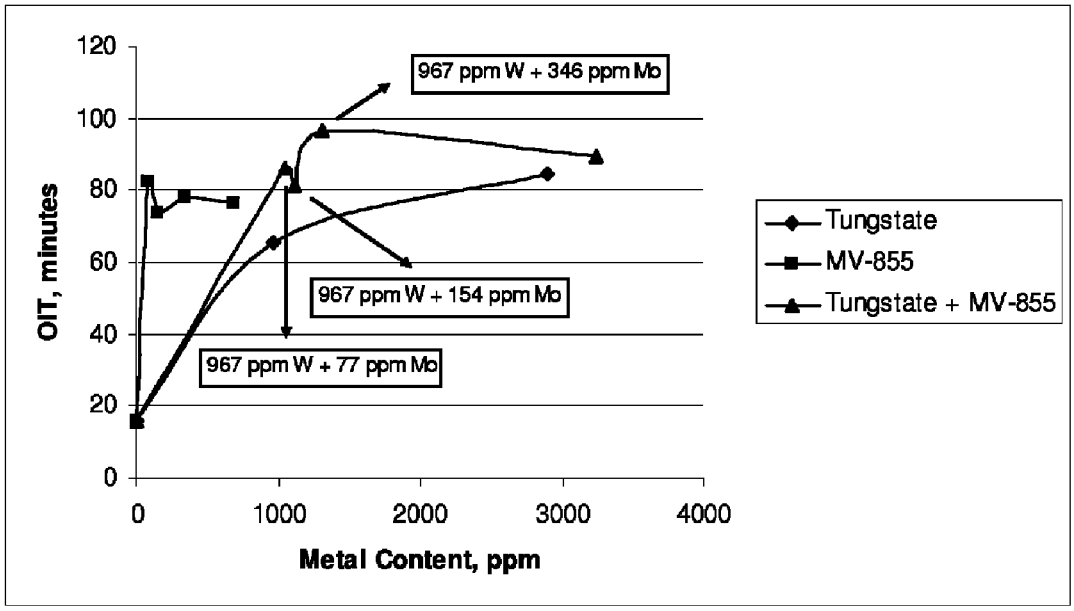
FIG. 1 is a plot showing metal content versus OIT's for Group I base oil containing 0.5 mass percent secondary diarylamine (VANLUBE® SL) in combination with (♦) different levels of ammonium tungstate (Example 1), (■) different levels of molybdate ester (MOLYVAN® 855), and (▲) different levels of Example 1 and MOLYVAN® 855 combinations.

The secondary diarylamines used in this invention should be soluble in a formulated oil package or package concentrate:

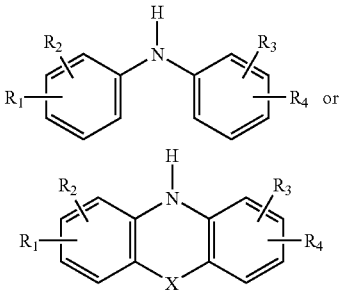

wherein $R_1$, $R_2$, $R_3$, and $R_4$ each independently represent hydrogen, alkyl, aralkyl, aryl, and alkaryl groups having 1 to about 20 carbons atoms per each group. Preferred groups are hydrogen, 2-methyl propenyl, 2,4,4-trimethyl pentenyl, styrenyl, and nonyl. A cyclic structure may be represented when X is either $(CH_2)_n$, S, or O and n is 0 to 2. Examples of these cyclic compounds are carbazoles, acridines, azepines, phenoxazines and phenothiazines.

(B) Organo Molybdenum Compound(s),

The organo molybdenum compounds used in this invention can be any oil soluble molybdenum compound including but not limited to dialkyldithiocarbamates, carboxylates, ammonium molybdates and molybdate esters, and mixtures thereof. Preferred are the molybdates esters, particularly molybdate esters prepared by methods disclosed in U.S. Pat. No. 4,889,647 and U.S. Pat. No. 6,806,241 B2, incorporate herein by reference. A commercial example is MOLYVAN® 855 additive, which is manufactured by R. T. Vanderbilt Company, Inc.

The organo molybdenum compounds of the invention may also be a molybdenum dialkyldithiocarbamate, which in turn may be a dinuclear centered complex of the following formula:

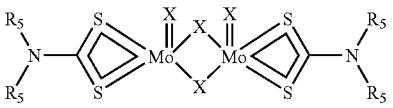

wherein $R_5$ is independently selected from organo groups that may be the same or different and X is either oxygen or sulfur. Preferably, the organo groups are hydrocarbyl groups such as alkyl, alkenyl, aryl, and substituted aryl and carbons atoms will preferably range from 1 to 30, and most preferably from 4 to 20. Preparations of these compounds are well known in the literature and U.S. Pat. Nos. 3,356,702 and 4,098,705 are incorporated herein for reference. Commercial examples include MOLYVAN® 807, MOLYVAN® 822, and MOLYVAN® 2000, which are manufactured by R. T. Vanderbilt Company Inc., SAKURA-LUBE® 165 and SAKURA-LUBE® 515, which are manufactured by ADEKA CORPORATION and Naugalube® MolyFM which is manufactured by Chemtura Corporation.

Trinulcear molybdenum dialkyldithiocarbamates are also known in the art, as taught by U.S. Pat. Nos. 5,888,945 and 6,010,987, herein incorporated by reference. Trinuclear molybdenum compounds preferably those having the formulas $Mo_3S_4(dtc)_4$ and $Mo_3S_7(dtc)_4$ and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil.

Molybdenum carboxylates are described in U.S. Pat. RE 38,929, and U.S. Pat. No. 6,174,842 and thus are incorporated herein by reference. Molybdenum carboxylates can be derived from any oil soluble carboxylic acid. Typical carboxylic acids include naphthenic acid, 2-ethylhexanoic acid, and linolenic acid. Commercial sources of carboxylates produce from these particular acids are MOLYBDENUM NAP-ALL, MOLYBDENUM HEX-CEM, and MOLYBDENUM LIN-ALL respectively. Manufacturer of these products is OMG OM Group.

Ammonium molybdates are prepared by the acid/base reaction of acidic molybdenum source such as molybdenum trioxide, molybdic acid, and ammonium molybdate and ammonium thiomolybdates with oil-soluble amines and optionally in presence of sulfur sources such sulfur, inorganic sulfides and polysulfides, and carbons disulfide to name few. The preferred aminic compounds are polyamine dispersants that are commonly used engine oil compositions. Examples of such dispersants are succinimides and Mannich type. References to these preparations are U.S. Pat. Nos. 4,259,194, 4,259,195, 4,265,773, 4,265,843, 4,727,387, 4,283,295, and 4,285,822.

(C) Organoammonium Tungstate Compound(s)

For this invention, organoammonium tungstates are prepared from the reaction of acidic forms of oxotungsten and organo compounds containing basic nitrogen or amines. Possible tungsten sources are listed, but not limited to those, in Table 1. Of these sources, tungstic acid, ammonium tungstate, ammonium paratungstate, and ammonium metatungstate react directly with amines. Tungsten trioxide is basic anhydride which most be hydrolyzed to produce tungstic acid. Preferred method of hydrolyzing tungsten trioxide is described by Tynik, U.S. Patent Application 2004/0214731 A1. In this method, tungsten trioxide is hydrolyzed with 2 equivalents caustic to produce metal tungstate hydrate that is then acidified with 2 equivalents of acid to form tungstic acid. Alternatively, tungstic acid can be produce directly from the acidification commercially available metal tungstates such as sodium tungstate dihydrate and calcium tungstate.

Polyoxotungstates, $[W_xY_y(OH)_z]^{n-}$, are formed when less than 2 equivalents of acid are used to neutralize metal tungstates, and also be used to organoammonium tungstates.

TABLE 1

Tungsten Sources

| Chemical Name | Chemical Formula |
|---|---|
| tungsten trioxide | $WO_3$ |
| tungstic acid | $H_2WO_4$ or $WO_3 \bullet H_2O$ |
| ammonium tungstate | $(NH_4)_2WO_4$ |
| sodium tungstate dihydrate | $(Na)_2WO_4 \bullet 2\ H_2O$ |
| calcium tungstate | $CaWO_4$ |
| ammonium paratungstate | $(NH_4)_{10}(HW_{12}O_{42}) \bullet 4H_2O$ |
| ammonium metatungstate | $(NH_4)_6(HW_{12}O_{40}) \bullet xH_2O$ wherein x typically 3 or 4. |

For this invention, reactant amines used in the formation of organoammonium tungstates will be defined as compounds containing basic nitrogen that can be measured by ASTM D 2896, Standard Test Method for base Number of Petroleum Products by Potentiometric Perchloric Acid Titration. It is expected that most amine compounds will undergo an acid/base reaction with tungsten sources described above. The primary requirement of the amine is make oil-soluble tungstate products. Preferred are alkyl mono-amines, e.g. as taught by U.S. Patent Application 2004/0214731 A1, and polyamine dispersants, which are essential components used in engine oils.

Alkyl mono-amines consist of the formula $R_5R_6NH$ wherein $R_5$ and $R_6$ are identical or different and selected from group consisting of hydrogen, linear or branched, saturated or unsaturated alkyl group containing 8 to 40 carbon atoms, or alkoxy groups containing 1 to 12 carbon atoms. Most preferred is di-($C_{11}$-$C_{14}$-branched and linear alkyl) amine, also known as 'di-tridecylamine', available from BASF Corporation, and di-n-octylamine Polyamine dispersants are based on polyalkenylamine compounds:

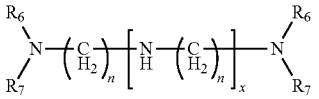

wherein $R_6$ and $R_7$ are independently hydrogen, normal and branched alkyl groups containing 1 to 25 carbon atoms, alkoxy groups containing 1 to 12 carbon atoms, alkylene groups containing 2 to 6 carbon atoms, and hydroxyl or amino alkylene groups containing 2 to 12 carbon atoms, x is 2 to 6, preferably 2 to 4, and n is 0 to 10, preferably 2 to 6. Particularly most preferred are triethylene tetramine, tetraethylene pentamine, and mixtures thereof in which $R_7$ and $R_8$ are both hydrogen, x is 2 to 3, and n is 2.

Polyamine dispersants are prepared by the reaction of polyalkenylamine compounds with carboxylic acids (ROOH) or reactive derivatives thereof; alkyl or alkenyl halides (R—X) and alkyl or alkenyl substituted succinic acid to respectively form carboxylic acid amides, hydrocarbyl substituted polyalkenylamines, and succinimides:

Typical of carboxylic acid amides are those disclose in U.S. Pat. No. 3,405,064, the disclosure of which is incorporated by reference. The products are either mono carboxylic acid amides as shown above or poly carboxylic acid amides in which more than one of the primary and secondary amines (—NH and $NH_2$) are transformed to carboxylic acid amides. The $R_9$ groups in carboxylic acid are 12 to 250 aliphatic carbon atoms. Preferred $R_9$ groups contain 12 to 20 carbon atoms and polyisobutenyl chains containing 72 to 128 carbon atoms.

Typical hydrocarbyl substituted polyalkenylamine compounds are disclosed in U.S. Pat. No. 3,574,576, the disclosure of which is incorporated by reference. The products are mono or poly substituted. Hydrocarbyl groups, $R_{10}$, are preferably 20 to 200 carbons atoms. Particularly preferred halides used in the formation of hydrocarbyl polyalkenylamine compounds are polyisobutenyl chlorides which contain 70 to 200 carbon atoms.

The preferred polyamine dispersants of this invention are the succinimides which are either mono or bis substituted and most preferred are mono-substituted succinimides:

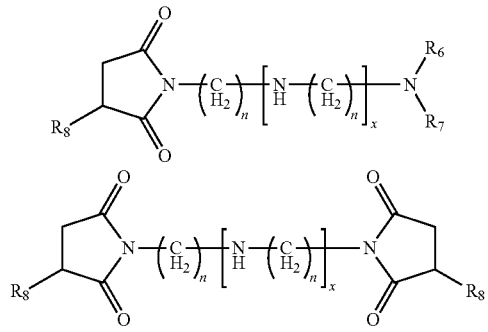

wherein $R_8$ is 8 to 400 carbon atoms and preferably 50 to 200 carbon atoms. Particularly preferred are succinimide dispersants which are derived from polyisobutenyl having molecular weight ranging from 800-2,500 grams per mole and polyethyleneamines such as triethylene tetramine, tetraethylene pentamine, and mixtures thereof. Specific commercial example of mono-substituted succinimide dispersant is Chevron ORONITE® OLOA 371, and OLOA 11,000, concentrated version of OLOA 371. Specific example of bis-substituted succinimide dispersant is HiTEC® 644 supplied by Afton Chemical Company.

Another type of dispersant is polyamine grafted viscosity index (VI) improvers. Plethora of patents teaching the preparation of these compounds is available. A sampling of this patents which hereby incorporated for reference are U.S. Pat. Nos. 4,089,794; 4,171,273; 4,670,173; 4,517,104; 4,632,769; and 5,512,192. Typical preparation involves pre-grafting olefin copolymers with ethylenically unsaturated carboxylic acid materials to produce an acylated VI improver. The acyl groups are then reacted with polyamines to form carboxylic acid amides and succinimides.

Another class of polyamine dispersants is Mannich base compositions. Typical Mannich bases which can be used in this invention are disclosed in U.S. Pat. Nos. 3,368,972, 3,539,663, 3,649,229, and 4,157,309. Mannich bases are typically prepared from alkylphenol having alkyl groups from 9 to 200 carbon atoms, an aldehydes, such formaldehyde and polyalkenylamine compounds, such triethylene tetramine, tetraethylene pentamine, and mixtures thereof.

For dispersant tungstates, one method of preparation involves two phase reaction of aqueous tungstic acid solution with dispersant a polyamine dispersant preferably diluted in oil. After appropriate reaction time, water is removed by vacuum distillation. The preferred stoichiometric ratio of tungstic acid to aminic nitrogen is 0.1 to 1.0, preferably 0.5 to 1.0, and most preferably 0.8 to 1.0. Second method preparation is novel and involves three phases, which are polyamine dispersant, water, and solid tungsten acid, $WO_3.H_2O$. After appropriate reaction time, water is removed by vacuum distillation. The preferred stoichiometric ratio of tungstic acid to aminic nitrogen is 0.1 to 1.5, preferably 0.5 to 1.0, and most preferably 0.8 to 1.0.

The combination of secondary diarylamine, organo molybdenum compound, and tungstate are particularly useful in enhancing antioxidant properties when added to lubricating compositions in amounts of 0.1 to 5.0 mass percent and most preferably from 1.0 to 2.0 mass percent. Specifically, oil compositions will contain about 0.01 to 0.5 mass (preferably about 0.1 to 0.5 mass) percent secondary diarylamine, 50 to 350 ppm molybdenum, and 500 to 3000 ppm tungsten (preferably about 500 to 1500 ppm tungsten).

The oil component of this invention is present in a major amount, i.e. at least 50 mass % of the overall lubricating composition, and may be one or combination of any mineral or synthetic oils of lubricating viscosity used as lubricant base stocks. Mineral oils may be paraffinic or naphthenic. Paraffinic oils may be of Group I solvent refined base oils, Group II hydrocracked base oils, and Group III high viscosity index hydrocracked base oils. Synthetic oils may consist of Group IV polyalphaolefin (PAO) type, and Group V synthetic oils, which include diesters, polyol esters, polyalkylene glycols, alkyl benzenes, organic esters of phosphoric acids, and polysiloxanes.

In addition to secondary diarylamine and organoammonium tungstate, lubricating composition may also include additional antioxidants hindered phenols, aromatic amines, zinc dithiophosphates (ZDDP), sulfurized hydrocarbons, metal and ashless dithiocarbamates, additional dispersants, detergents, additional antiwear additives including ZDDP, friction modifiers, viscosity modifiers, pour point depressants, anti-foam additives, and demulsifiers.

To illustrate various organoammonium tungstate compositions of the invention, the following methods preparation are provided as illustrative examples. The following examples are provided for illustrative purposes only and are not to place any limitation on the scope of the invention where such scope is set out only in the claims.

Example 1

Preparation Ammonium Tungstate from PIB (Polyisobutylene) Mono-Succinimide Polyamine Dispersant Sodium tungstate dihydrate (33.0 g) is dissolved in 75.0 g of water and then slowly acidified with 35.3 g of a 28% sulfuric acid solution. A solution of 105.8 g of a mono-succinimide dispersant (OLOA® 371; 46.7% active in process oil; TBN=53.0) and 65.0 g of process oil is warmed to 50° C. and charged as a whole to the turbid light-yellow tungsten solution under vigorous stirring, along with 4 drops of Antifoam B®. The reaction mixture is then heated at reflux until approximately 75% of the water is distilled off. Vacuum is then slowly applied and the temperature is raised to 125-130° C. and held for 30 minutes. The reaction mixture is then filtered hot through diatomaceous earth yielding clear viscous dark amber oil. Tungsten content was determined to be 9.67 mass percent.

Example 2

Preparation Di-($C_{11}$-$C_{14}$-Branched and Linear Alkyl) Ammonium Tungstate

Sodium tungstate dihydrate (132.0 g) is dissolved in 250.0 g of water and then slowly acidified with 138.7 g of a 26.8% sulfuric acid solution. A solution of di-($C_{11}$-$C_{14}$-branched and linear alkyl) amine (97.7%; 157.9 g) in 150 g heptanes is then charged as a whole to the turbid light-yellow tungsten solution under vigorous stirring. The reaction mixture is then heated to reflux for 30 minutes, after which the aqueous phase is separated and the organic phase is transferred to a rotary evaporator whereupon solvent is removed. Residual solids are removed via filtration. Product is then obtained as clear yellow viscous oil. Tungsten content was determined to be 29.5 mass percent.

Example 3

Preparation Ammonium Tungstate from PIB Mono-Succinimide Polyamine Dispersant

To a solution of 46.9 g of dispersant (OLOA® 11000; 71.2% active in process oil; TBN=76.3) and 64.5 g of process oil is charged 16.0 g of tungstic acid and 16 g of water. The stirred solution is then heated 100° C. over 10 minutes and then slowly heated to 160° C. over 1 hour while collecting distillate. When distillation ceases, vacuum is applied to the system and the reaction is continued at 160° C. with stirring until the reaction mixture is brown. It is then filtered hot through a diatomaceous earth. Tungsten content was determined to be 5.31%.

Example 4

Preparation Ammonium Tungstate from PIB Mono-Succinimide Polyamine Dispersant

To a solution of 50.2 g of dispersant (60% active in process oil; $PIB_{MW}$=2100; TBN=87.8) and 50.1 g of process oil is charged 7.6 g of tungstic acid and 7.6 g of water. The stirred slurry is then heated to 120° C. and distillation of water begins. The temperature is then slowly increased to 160° C. and the reaction begins to turn green as distillation continues. When distillation ceases, vacuum is applied to the system and the reaction is continued at 160° C. with stirring until the reaction mixture is brown. It is then filtered hot through a diatomaceous earth. Tungsten content was determined to be 2.6 mass percent.

Example 5

Preparation Ammonium Tungstate from PIB Mono-Succinimide Polyamine Dispersant

To a solution of 46.5 g of a mono-succinimide dispersant (60% active in process oil; $PIB_{MW}$=2100; TBN=44.30) and 46.5 g of process oil is charged 9.0 g of tungstic acid and 10.6 g of water. The stirred slurry is then slowly heated to 160° C. with reflux. At 160° C. distillate is collected causing a color change to olive green. When distillation ceases, vacuum is applied to the system and the reaction is continued at 160° C. with stirring until the reaction mixture is brown. It is then filtered hot through a diatomaceous earth. Tungsten content was determined to be 4.4 mass percent.

Example 6

Preparation Ammonium Tungstate from PIB Mono-Succinimide Polyamine Dispersant

To a solution of 49.8 g of a mono-succinimide dispersant (60% active in process oil; $PIB_{MW}$=1000; TBN=33.52) and 49.9 g of process oil is charged 19.6 g of tungstic acid and 15.1 g of water. The stirred slurry is then slowly heated to 160° C. and the distillate collected as the mixture turns dark green. When distillation ceases, vacuum is applied to the system and the reaction is continued at 160° C. with stirring until the reaction mixture is brown. It is then filtered hot through a diatomaceous earth. Tungsten content was determined to be 8.72 mass percent.

Example 7

Preparation Ammonium Tungstate from PIB Mono-Succinimide Polyamine Dispersant

To a solution of 67.42 g of a bis-succinimide dispersant (approximately 75% active in process oil; TBN=47.20) and 16.8 g of process oil is charged 14.24 g of tungstic acid and 9.35 g of water. The stirred slurry is then heated to 99-101° C. for 1.5 hours. It is then slowly heated to 160° C. over 2.5 hours and held at 160° C. for 1.5 hours while the distillate is collected and the mixture turns green. When distillation ceases, vacuum is applied to the system and the reaction is continued at 160° C. with stirring until the reaction mixture is brown. It is then filtered hot through a diatomaceous earth. Tungsten content was determined to be 4.52 mass percent.

Example 8

Preparation Ammonium Tungstate from PIB Bis-Succinimide Polyamine Dispersant

To a solution of 50.5 g of a mono-succinimide dispersant (60% active in process oil; $PIB_{MW}$=2100; TBN=44.30) and 50.5 g of process oil is charged 5.01 g of tungstic acid and 4.22 g of water. The stirred slurry is then slowly heated to 160° C., at which point the distillate collected as the mixture turns dark green. When distillation ceases, vacuum is applied to the system and the reaction is continued at 160° C. with stirring until the reaction mixture is brown. It is then filtered hot through a diatomaceous earth. Tungsten content was determined to be 1.9 mass percent.

To illustrate various functional fluid compositions, specifically lubricant compositions, comprising the compositions of the present invention the following illustrative examples are provided. The following examples are provided for illustrative purposes only and are not to place any limitation on the scope of the invention where such scope is set out only in the claims.

Oxidation Stability Testing

Oxidation stability was measured by pressurized differential scanning calorimetry (PDSC) as described by ASTM D 6186. PDSC measures oxidation stability by detecting exothermic release of heat when antioxidant capacity of a lubricating composition is depleted and the base oil goes into oxidative chain reaction known as autooxidation. The time from the start of the experiment to autooxidation is known as oxidation induction time (OIT). Thus, longer OIT's indicate greater oxidative stability and antioxidant capacity.

Example 9

VANLUBE SL, an octylated/styrenated secondary diarylamine supplied by R. T. Vanderbilt Company Inc., MOLYVAN 855, a molybdate ester manufactured by R. T. Vanderbilt Company Inc., and the ammonium tungstate of Example 1 were blended Unocal 90 Group I base oil as shown in Table 2. The OIT's of the oils were measured by PDSC at 180 C. Examples 1 though 5 demonstrate the expected two component synergy that is known for secondary diarylamines and the organomolybdenum compounds and Examples 9 through 12 demonstrate the expected two component synergy of secondary diarylamines and the ammonium tungstates. However, FIG. 1 also shows a leveling point at higher molybdenum and tungsten contents at which significant increase oxidation stability is no longer observed. Unexpectedly, a more potent synergy is seen when the secondary diarylamine is combined with both the molybdate ester and ammonium tungstate at intermediate metal contents, thus producing lubricating compositions with significantly higher oxidation stability while maintaining molybdenum and tungsten contents at relatively low levels.

TABLE 2

(data in mass percent, unless indicated otherwise)

| Components | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Base Oil | 99.9 | 99.5 | 99.55 | 99.1 | 99.4 | 99.3 | 99.05 | 98.6 | 99.0 | 98.0 | 98.5 | 96.5 | 98.4 | 98.3 | 98.05 | 96.05 |
| Vanlube ® SL | 0.1 | 0.5 | | | 0.5 | 0.5 | 0.5 | 0.5 | | | 0.5 | 0.5 | 0.5 | 0.5 | 0.5 | 0.5 |
| Tungstate, Example 1 | | | | | | | | | 1.0 | 3.0 | 1.0 | 3.0 | 1.0 | 1.0 | 1.0 | 3.0 |
| Molyvan ® 855 | | | 0.45 | 0.9 | 0.1 | 0.2 | 0.45 | 0.9 | | | | | 0.1 | 0.2 | 0.45 | 0.45 |
| Mo Content, ppm | 0 | 0 | 350 | 700 | 77 | 254 | 350 | 700 | 0 | 0 | 0 | 0 | 77 | 154 | 350 | 350 |
| W, Content, ppm | 0 | 0 | 0 | 0 | 0 | 0 | 0 | 0 | 967 | 2901 | 967 | 2901 | 967 | 967 | 967 | 2901 |
| OIT, minutes | 8.2 | 15.8 | 38.5 | 43.1 | 82.6 | 73.7 | 78.2 | 76.6 | 3.8 | 3.8 | 65.7 | 84.2 | 86.2 | 81.3 | 96.9 | 89.4 |

Example 10

VANLUBE SL, an octylated/styrenated secondary diarylamine supplied by R. T. Vanderbilt Company Inc., the ammonium tungstate of Example 1, and different types of organomolybdenum compounds were blended Unocal 90 Group I base oil as shown in Table 3. The OIT's of the oils were measured by PDSC at 180 C. Experiments 17-18 are analogous experiment 15 in which secondary diarylamine, ammonium tungstate, and molybdate ester, and show that this other organo molybdenum compounds are equally effective as molybdate ester in increasing OIT's of lubricating composition containing secondary diarylamine and ammonium tungstate.

TABLE 2

(data in mass percent, unless indicated otherwise)

| Components | 17 | 18 | 19 |
|---|---|---|---|
| Base Oil | 97.86 | 98.15 | 97.64 |
| Vanlube ® SL | 0.5 | 0.5 | 0.5 |
| Tungstate, Example 1 | 1.0 | 1.0 | 1.0 |
| Trinuclear molybdenum dithiocarbamate (MoDTC)[1] | 0.64 | | |
| Dinuclear MoDTC[2] | | 0.35 | |
| MoDTC[3] | | | 0.86 |
| Mo Content, ppm | 350 | 350 | 350 |
| W Content, ppm | 967 | 967 | 967 |
| OIT, minutes | 95.4 | 100.1 | 92.6 |

[1]Trinuclear MoDTC is Infineum C9455B, which is manufactured by INFINEUM.
[2]MoDTC is SAKURA-LUBE ® 515, which is manufactured by ADEKA CORPORATION
[3]MoDTC is Naugalube ® MolyFM which is manufactured by Chemtura Corporation.

Example 11

Figure 2:
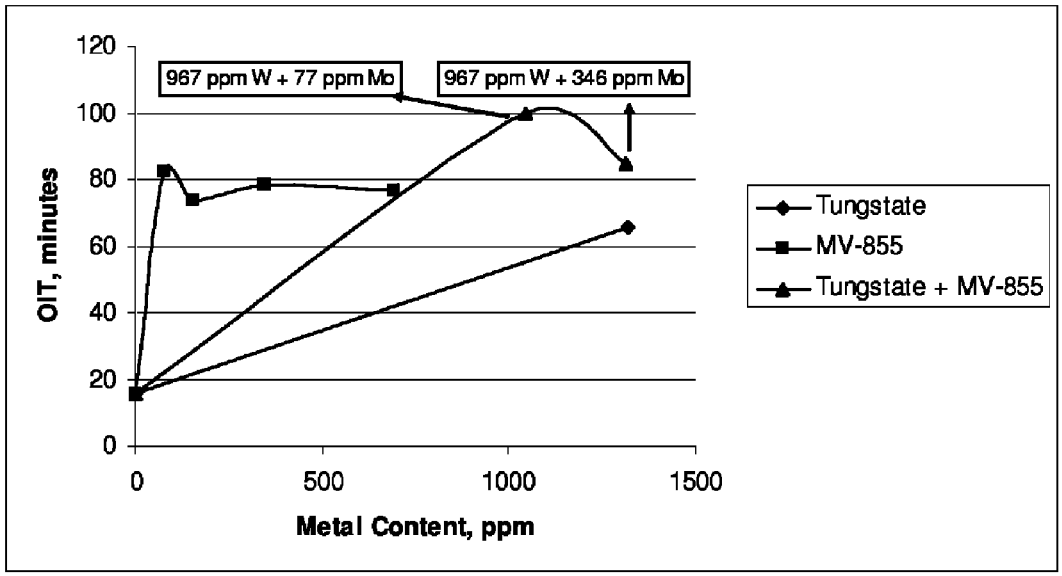
FIG. 2 is a plot showing metal content versus OIT's for Group I base oil containing 0.5 mass percent secondary diarylamine (VANLUBE® SL) in combination with (♦) different levels of ammonium tungstate (Example 2), (■) different levels of molybdate ester (MOLYVAN® 855), and (▲) different levels of Example 2 and MOLYVAN® 855 combinations.

VANLUBE SL, an octylated/styrenated secondary diarylamine supplied by R. T. Vanderbilt Company Inc., the ammonium alkyl tungstate of Example 2, and MOLYVAN 855, a molybdate ester manufactured by R. T. Vanderbilt Company Inc. blended Unocal 90 Group I base oil as shown in Table 3. The OIT's of the oils were measured by PDSC at 180 C. As depicted by FIG. 2, the data shows that higher OIT's are obtain with three component compositions over two component combinations. However unlike dispersant tungstate of Example 1, the optimum response is obtain at lower molybdenum contents.

TABLE 3

(data in mass percent, unless indicated otherwise)

| Components | 20 | 21 | 22 |
|---|---|---|---|
| Base Oil | 99.0 | 99.0 | 98.65 |
| Vanlube ® SL | 0.5 | 0.5 | 0.5 |
| Tungstate, Example 2 | 0.5 | 0.4 | 0.4 |
| Molyvan ® 855 | | 0.1 | 0.45 |
| Mo Content, ppm | 0 | 77 | 154 |
| W Content, ppm | 1,320 | 967 | 967 |
| OIT, minutes | 35.9 | 99.8 | 84.4 |

What is claimed is:

1. A lubricating oil composition comprising a major portion of a lubricating base oil and an antioxidant additive at about 0.1-1.5 mass percent, the additive comprising:

(a) a secondary diarylamine at about 0.5 mass percent, (b)

(i) a molybdenum dialkyldithiocarbamate or molybdate ester in an amount which provides about 50 to about 200 ppm molybdenum, or (ii) an ammonium molybdate in an amount which provides about 50 ppm molybdenum; and (c) di-($C_{11-14}$-branched and linear alkyl) amine tungstate or mono-succinimide tungstate in an amount which provides about 100 to 500 ppm tungsten.

2. The lubricating composition of claim 1, wherein the secondary diarylamine comprises

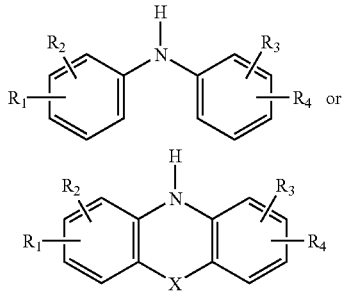

wherein $R_1$, $R_2$, $R_3$, and $R_4$ each independently represent hydrogen, alkyl, aralkyl, aryl, and alkaryl groups having 1 to about 20 carbons atoms per each group, wherein X is either $(CH_2)_n$, S, or O and n is 0 to 2, or X is two hydrogens bound to their respective carbons in a secondary diphenylamine structure.

3. The lubricating composition of claim 2, wherein at least one of $R_1$, $R_2$, $R_3$, and $R_4$ are each independently chosen from hydrogen, 2-methyl propenyl, 2,4,4-trimethyl pentenyl, styrenyl and nonyl.

4. The lubricating composition of claim 2, wherein the secondary diarylamine is chosen from octylated/butylated secondary diarylamine, p,p'-dioctylated secondary diarylamine and octylated/styrenated secondary diarylamine.

5. The lubricating composition of claim 1, comprising a molybdenum dialkyldithiocarbamate or molybdate ester in an amount which provides about 50 to about 200 ppm molybdenum.

6. The lubricating composition of claim 1, comprising an ammonium molybdate in an amount which provides about 50 ppm molybdenum.

7. The lubricating composition of claim 6, wherein the ammonium molybdate is di-($C_{11-14}$-branched and linear alkyl) ammonium molybdate.

* * * * *